US006715285B2

(12) United States Patent
Isaac, Jr.

(10) Patent No.: US 6,715,285 B2
(45) Date of Patent: Apr. 6, 2004

(54) STIRLING ENGINE WITH HIGH PRESSURE FLUID HEAT EXCHANGER

(75) Inventor: Donald Isaac, Jr., Half Moon Bay, CA (US)

(73) Assignee: Mandi Company, Half Moon Bay, CA (US)

( * ) Notice: Subject to any disclaimer, the term of this patent is extended or adjusted under 35 U.S.C. 154(b) by 0 days.

(21) Appl. No.: 10/205,697

(22) Filed: Jul. 26, 2002

(65) Prior Publication Data

US 2002/0189785 A1 Dec. 19, 2002

Related U.S. Application Data

(62) Division of application No. 09/754,467, filed on Jan. 4, 2001.

(51) Int. Cl.[7] ..... F01B 29/10
(52) U.S. Cl. ..... 60/520; 60/524
(58) Field of Search ..... 60/517, 518, 520, 60/524, 526

(56) References Cited

U.S. PATENT DOCUMENTS

| | | | | |
|---|---|---|---|---|
| 1,818,343 A | | 8/1931 | Monroe | |
| 1,833,876 A | | 11/1931 | McGrath | |
| 1,854,619 A | | 4/1932 | Mortensen | |
| 2,042,141 A | | 5/1936 | Campbell | 257/244 |
| 2,341,319 A | | 2/1944 | Graham et al. | 257/246 |
| 2,730,337 A | | 1/1956 | Roswell | 257/246 |
| 2,756,032 A | | 7/1956 | Dowell | 257/246 |
| 3,158,192 A | | 11/1964 | Mizer et al. | 158/28 |
| 3,736,761 A | * | 6/1973 | Richmond et al. | 62/6 |

OTHER PUBLICATIONS

Publication from the Department of Defense, FY 2000 Small Business Innovation Reasearch (SBIR) Program, program solicitation No. 00.1, 4 pages.
"Theory and Design of Modern Pressure Vessels" by John F. Harvey, the Van Nostrand Reinhold Company, second edition, circa 1974, pp. 29–34.
Theory and Design of Modern Pressure Vessels by John F. Harvey, the Van Nostrand Reinhold Company, second edition, circa 1974, pp. 120–122.
"The Philips Stirling Engine" by C. M. Hargreaves, 1991, pp. 40–43.
"The Philips Stirling Engine" by C. M. Hargreaves, 1991, pp. 185–191.
"Stirling Engines" by G. Walker, Clarendon Press, 1980, pp. 124–159.
Publication– Stirling Machine World, Mar. 1999, 18 pages.
Publication– Stirling Machine World, Jun. 1997, 4 pages discloses Stirling development activities at Tamin Industries.

(List continued on next page.)

*Primary Examiner*—Hoang Nguyen
(74) *Attorney, Agent, or Firm*—Gordon & Jacobson, P.C.

(57) ABSTRACT

A Stirling engine includes a heat exchanger having helical and axial fins forming an orthogonal grillage on either side of a pressure resisting wall, and an outer reinforcing sleeve about the helical fins. The sleeve improves the pressure resisting ability of a thin separating wall between a pressurized fluid and an outside working environment, resulting in a high-pressure and temperature heat exchanger with high heat transfer efficiency. In addition, the sleeve and helical fins together define fluid passages for the flow of heating fluid. The heat exchanger according to the invention has the ability to resist high pressures at high temperatures without excessive distortion, has improved heat transfer capability, better reliability, and lower production cost than prior art heat exchangers.

28 Claims, 3 Drawing Sheets

U.S. PATENT DOCUMENTS

| | | | | | |
|---|---|---|---|---|---|
| 3,855,795 | A | * | 12/1974 | Noble et al. | 60/524 |
| 3,861,146 | A | * | 1/1975 | Lynch et al. | 60/524 |
| 4,286,140 | A | | 8/1981 | Dewulf et al. | 219/306 |
| 4,392,351 | A | * | 7/1983 | Doundoulakis | 60/526 |
| 4,455,154 | A | | 6/1984 | Blasiole | 48/77 |
| 4,753,072 | A | * | 6/1988 | Johansson et al. | 60/517 |
| 4,869,313 | A | | 9/1989 | Fredley | 165/41 |
| 5,027,971 | A | | 7/1991 | Perryman | 220/426 |
| 5,214,923 | A | * | 6/1993 | Kown | 62/6 |
| 6,279,318 | B1 | | 8/2001 | Conrad | 60/520 |
| 6,279,319 | B1 | | 8/2001 | Conrad | 60/520 |
| 6,282,895 | B1 | | 9/2001 | Johansson et al. | 60/524 |
| 6,286,310 | B1 | | 9/2001 | Conrad | 60/520 |
| 6,293,101 | B1 | | 9/2001 | Conrad | 60/520 |
| 6,311,490 | B1 | | 11/2001 | Conrad | 60/520 |
| 6,311,491 | B1 | | 11/2001 | Conrad | 60/520 |
| 2002/0029567 | A1 | | 3/2002 | Kamen et al. | 60/517 |

* cited by examiner

STIRLING ENGINE WITH HIGH PRESSURE FLUID HEAT EXCHANGER

This application is a divisional of U.S. Ser. No. 09/754,467, filed Jan. 4, 2001, which is hereby incorporated by reference herein in its entirety.

BACKGROUND OF THE INVENTION

1. Field of the Invention

This invention relates broadly to Stirling engines. More particularly, the invention relates to a Stirling engine having a fluid heat exchanger adapted to have improved heat transfer and operate under high pressure and temperature.

2. State of the Art

Frequently heat energy must be exchanged between two or more fluids which do not mix and which may be flowing or stagnant. The heat energy is transferred from the hotter fluid to a separating wall by convection and/or radiation. Heat energy is conducted through the wall from the hot side to the cold side. Heat energy is then transferred from the separating wall to the cooler fluid by convection and/or radiation. The purpose of the heat exchanger may be to raise the temperature of a relatively cool fluid (as a heater) or to lower the temperature of a relatively hot fluid (as a cooler).

Except for radiative only heat exchangers, all heat exchangers have large surfaces where heat energy is absorbed or given off by the surface contacted by the fluids. There are basically three types of fluid heat exchangers for Stirling engines defined by the fluid interfacing configurations. Heat exchangers for Stirling engines may be annular, finned, or tubular, or various combinations of these. Annular heat exchangers consist of concentric tubes with the fluids contained in or between them. The tubes may be cylindrical or of other closed cross sections. One tube separates the fluids and provides the surface area and conductive path required for heat exchange. Finned heat exchangers increase the surface area exposed to one or both fluids by providing finned structures on one or both sides of the wall, which effectively increase the surface area of the wall thus improving heat transfer. Tubular heat exchangers contain one fluid within relatively small diameter tubes that are surrounded by the other fluid. Heat is conducted through the tube wall. Various combinations of these three types may also be used in a heat exchanger. For example, fins may be added to the tubes of an annular heat exchanger to increase the contacted surface area.

Annular (with and without fins) and tubular heat exchangers have been used for Stirling engines. Tubular heat exchangers (with and without fins) have been traditionally used for engines with power outputs greater than 1 kW mechanical. Many small diameter tubes provide large surface area and the small diameters have lower stress at high pressures. Tubular heat exchangers are the most expensive to produce and are susceptible to burnout due to uneven heating and high stresses at the attachment points due to thermal expansion deformation of long tubes.

Often one or more of the fluids may be pressurized to a relatively high level. In such case, the separating wall must structurally resist the difference in pressure between the fluids. For high heat exchanger efficiency, large fluid contacted surfaces and low thermal resistance through the separating wall are desired. Low thermal resistance is achieved by using a thin separating wall, large contact area, and a material with high thermal conductivity. On the other hand, high structural strength to resist deformation by pressure is achieved by using thick walls, small surface areas, and high strength materials. In general materials with high thermal conductivity do not have high strength and high strength materials have low thermal conductivity. Thus, the desired characteristics of heat exchanger designs assuring high thermal efficiency and high strength conflict.

With particular reference to Stirling engines, such engines are typically provided with four heat exchangers: a heater, a regenerator, a cooler, and an exhaust/inlet air preheater. A more detailed explanation of the respective functions of the heat exchangers of Stirling engines can be found in G. Walker in "Stirling Engines", Clarendon Press, 1980, pp. 124–126, 133–144, and 156–159, which is hereby incorporated by reference herein in its entirety. The above described annular, tubular, and finned heat exchangers, as well as combinations thereof, have all been used in various Stirling engines for heaters and coolers. For example, U.S. Pat. No. 4,671,064, which is hereby incorporated by reference herein in its entirety, describes an annular heat exchanger for a Stirling engine. C. M. Hargreaves in "The Philips Stirling Engine", Elsevier, 1991, pp. 185–187, describes finned heat exchangers (referred to as "concertina" and "partition" heaters) in Stirling engines.

For maximum efficiency, the Stirling engine working fluid temperature should be as high (as close to the heating fluid temperature) as possible at the heater and as low (as close to the cooling fluid temperature) at the cooler as possible. For maximum power production, the working fluid pressure should be as high as possible. This requires high thermal conductivity of the wall separating the fluids and high strength at the operating temperature. Heating fluid temperature should be as high as the heat exchanger construction material can withstand at the working fluid pressure.

One manner of increasing the pressure-resisting strength of a pressure vessel is to use "orthogonal grillage" about a separating wall; i.e., providing straight internal fins parallel to the cylinder axis combined with disk-like external fins perpendicular to the axis and integral to the separating wall. The straight and disk-like fins cross each other at right angles. "Orthogonal grillage" is described in more detail in J. F. Harvey in "Theory and Design of Modern Pressure Vessels", $2^{nd}$ Ed., Van Norstrand Reinhold, 1974, pp. 120–122, which is hereby incorporated by reference herein in its entirety. However, orthogonal grillage has the disadvantage in that it is complicated and difficult to move a heating fluid around the pressure vessel to permit the heat exchange.

SUMMARY OF THE INVENTION

It is therefore an object of the invention to provide a heat exchanger for heating or cooling a fluid in a high pressure vessel.

It is another object of the invention to provide a heat exchanger which has a relatively high structural integrity.

It is a further object of the invention to provide a heat exchanger through which it is relatively easy to circulate heating fluid.

It is an additional object of the invention to provide a heat exchanger which has a high heat transfer efficiency.

It is also an object of the invention to provide a heat exchanger which is relatively light weight.

It is still another object of the invention to provide a heat exchanger which is relatively inexpensive to manufacture.

It is yet another object of the invention to provide a heat exchanger for a Stirling engine.

In accord with these objects, which will be discussed in detail below, an annular heat exchanger having helical fins is provided. According to preferred aspect of the invention, an outer reinforcing sleeve is provided about the helical fins. The sleeve improves the pressure resisting ability of a thin separating wall (e.g., the heater wall of a Stirling engine) resulting in a high-pressure heat exchanger with high heat transfer efficiency. In addition, the sleeve and helical fins together define fluid passages for the flow of a heating fluid.

The heat exchanger according to the invention has an ability to resist high pressures at high temperatures without excessive or permanent distortion, has an improved heat transfer capability, better reliability, and lower production cost than prior art heat exchangers.

Additional objects and advantages of the invention will become apparent to those skilled in the art upon reference to the detailed description taken in conjunction with the provided figures.

DETAILED DESCRIPTION OF THE PREFERRED EMBODIMENT

Figure 1:
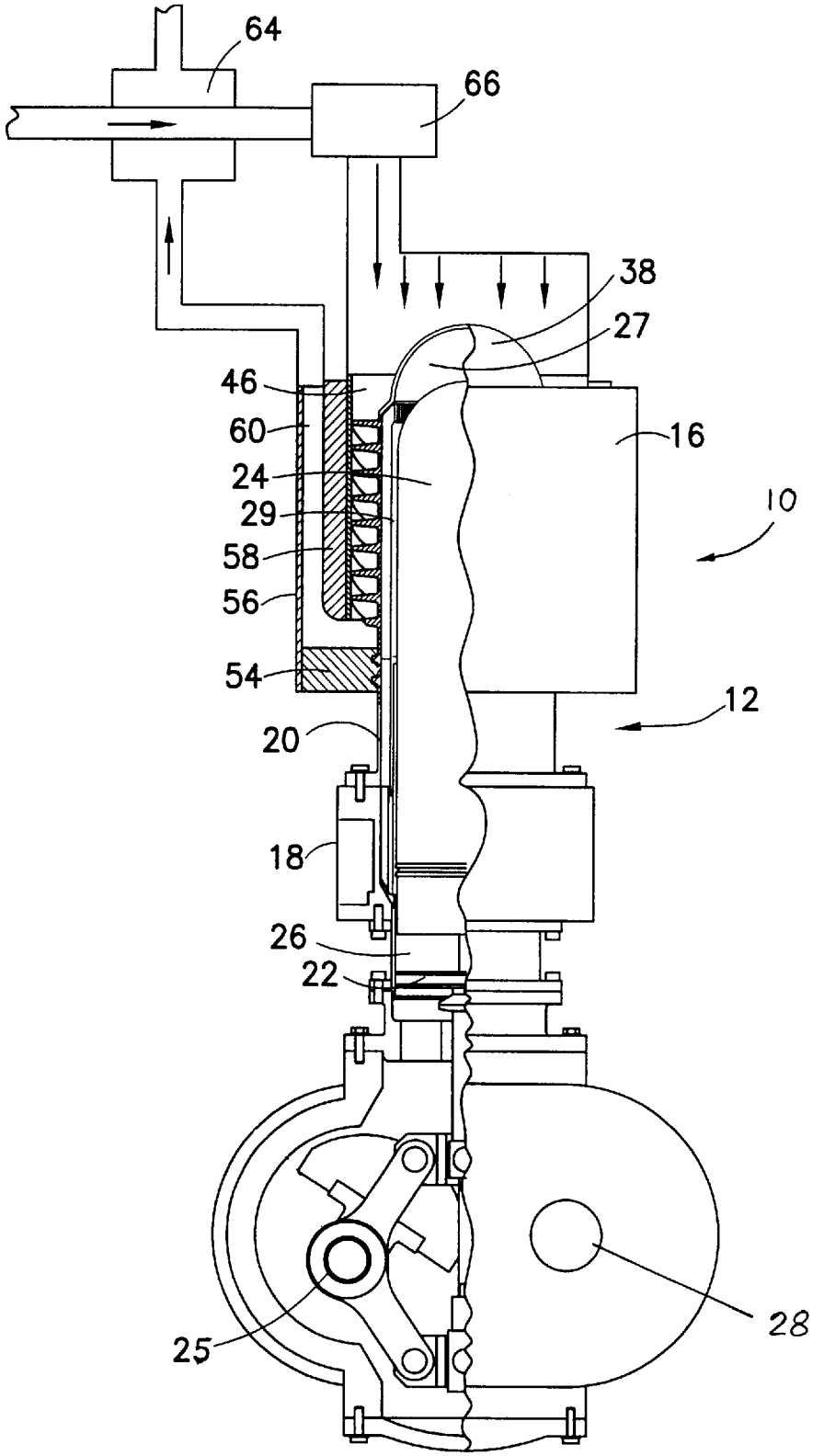
FIG. 1 is a partial cut-away side elevation view of a Stirling engine according to the invention.
Figure 2:
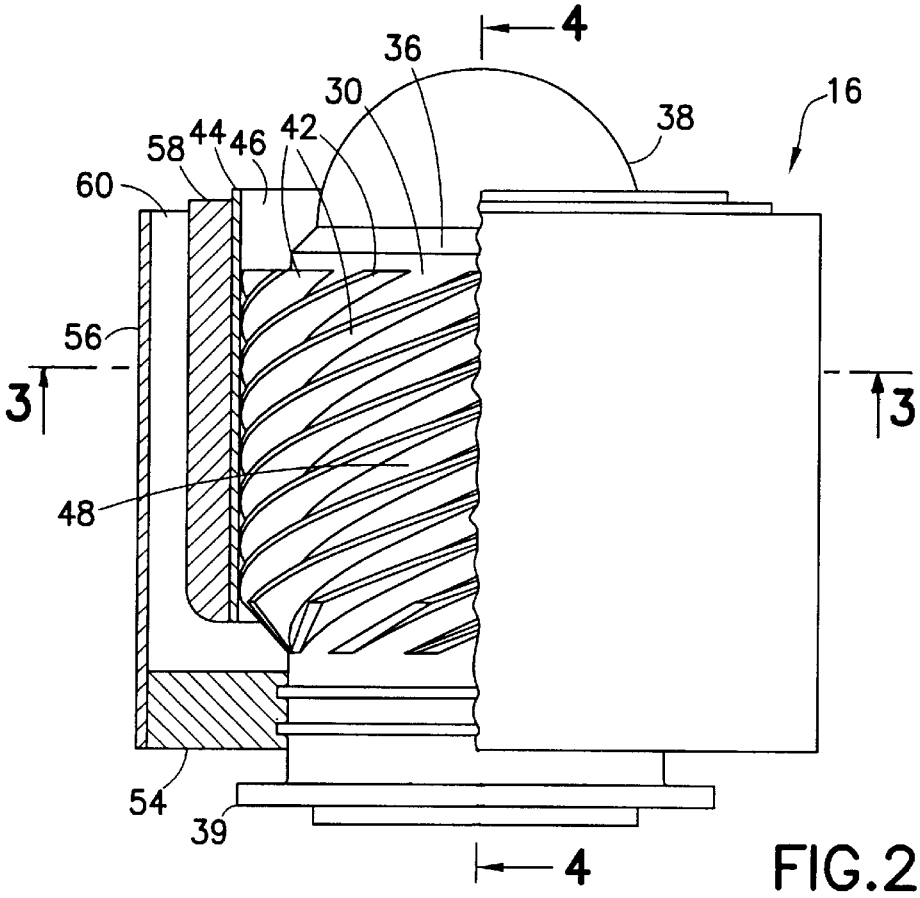
FIG. 2 enlarged partial cut-away side elevation view of a hot end heat exchanger and heating fluid passages of a Stirling engine according to the invention, revealing heating fluid passages.
Figure 3:
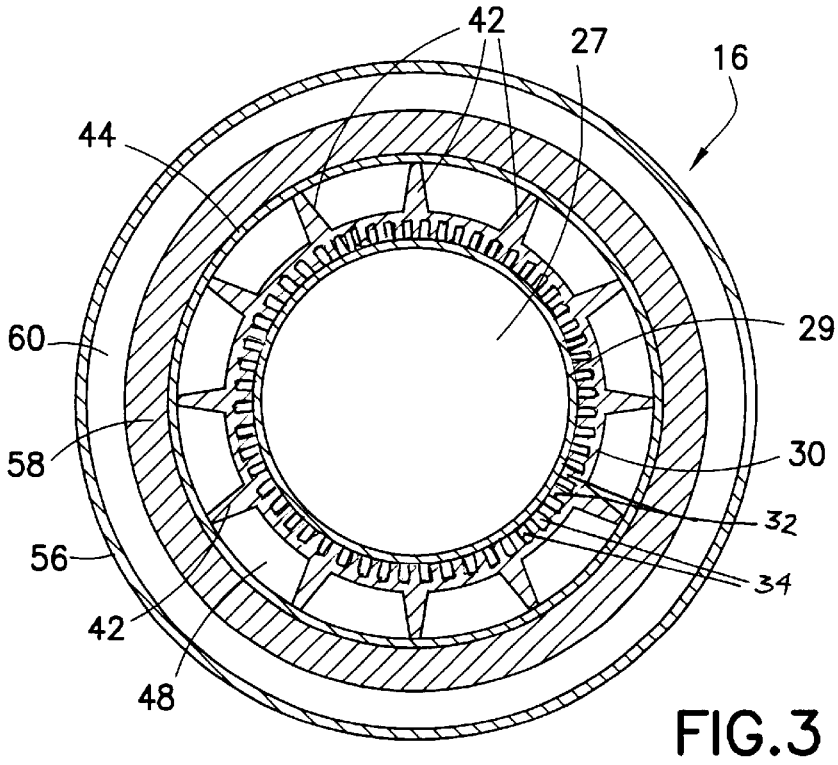
FIG. 3 is a section view across line 3—3 in FIG. 2.
Figure 5:
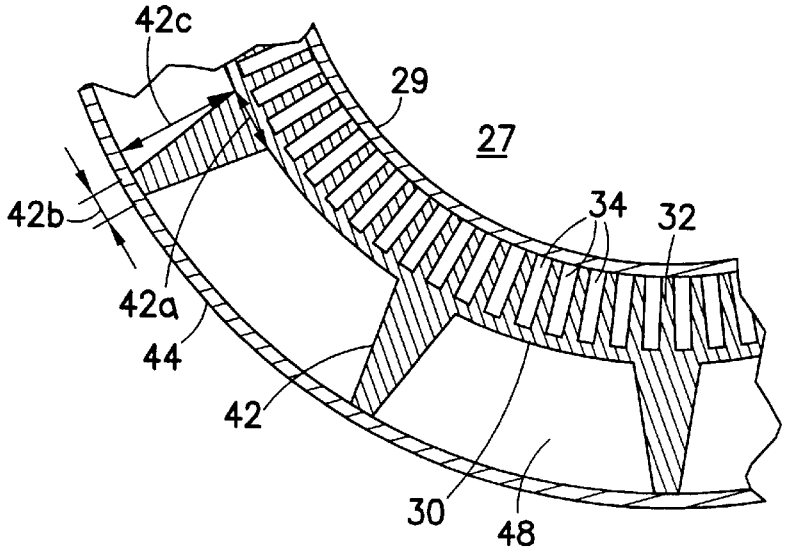
FIG. 5 an enlarged section through a cylinder wall, and heater wall fins and outer sleeve of the heat exchanger according to the invention.
Figure 4:
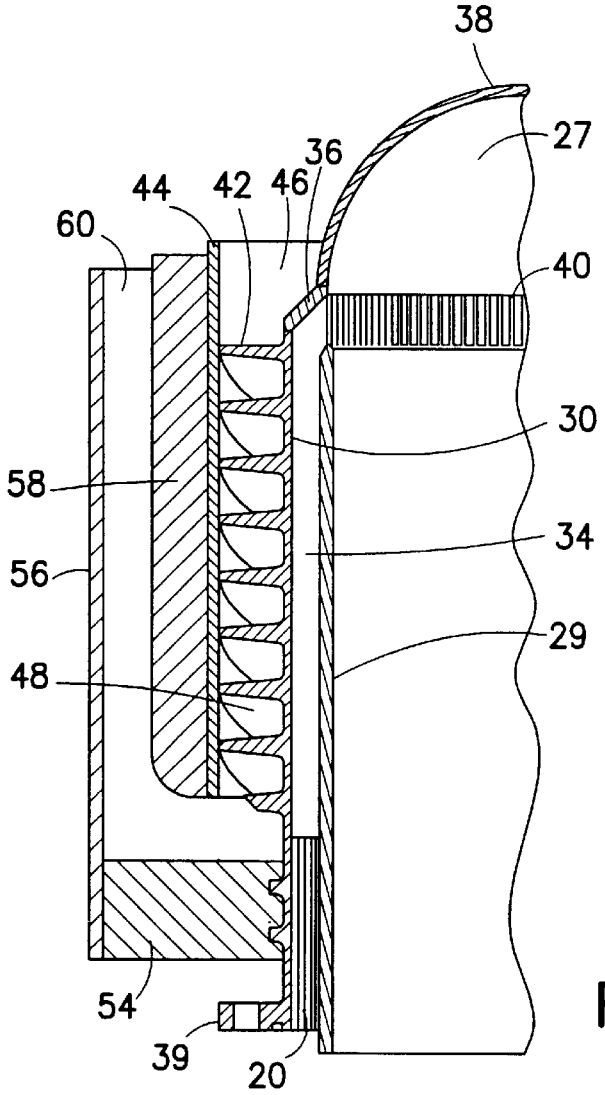
FIG. 4 is a section view across line 4—4 in FIG. 2.

Referring now to FIG. 1, a Stirling engine 10 generally includes a pressure vessel 12, a hot end heat exchanger (heater) 16, a cold end heat exchanger (cooler) 18, a regenerator 20, a piston 22, a displacer 24, and a crank assembly 25. The pressure vessel 12 defines a working space containing a pressurized working fluid (not shown). The heater 16 (described in detail below) adds heat to the working fluid in the pressure vessel (to increase total working fluid pressure in the system). The cooler 18 removes heat from the working fluid (and decreases total working fluid pressure in the system). The regenerator 20 serves as a thermal storage medium and increases the engine efficiency by reducing energy losses as the working fluid is alternately transferred between the hot and cold ends. The heater 16 is preferably integrated with the regenerator 20, and both are preferably positioned on top of the cooler 18.

The working space, mentioned above, is defined as all of the space or internal volume occupied by the working fluid, and includes the fixed internal volumes of the heater 16, regenerator 20, and cooler 18 as well as any connecting ducts or passageways. The working space also includes a variable compression space 26 and a variable expansion space 27. The compression space 26 is the volume contained between the displacer 24 and the piston 22 that varies as the displacer 24 and piston 22 move axially in a cylinder 29 (discussed below) relative to each other. The expansion space 27 is the volume contained between the displacer 24 and a closed hot end of the pressure vessel (end cap 38, discussed below).

The axial position of the displacer 24 in the cylinder 29 is always ahead of the position of the piston 22 with respect to time. Oscillating motion of the displacer 24 transfers or displaces working fluid alternately between the compression space 26 and expansion space 27. Working fluid flow to and from the compression space 26 and expansion space 27 must flow through the heater 16, regenerator 20 and cooler 18.

In general, the working fluid pressure in the total working space is uniform at any instant in time. When working fluid flow is from the regenerator 20, through the heater 16, and into the expansion space 27, working fluid temperature and pressure increase and the piston 22 is forced out by having a higher pressure on the working fluid side than on the opposite side. When working fluid flow is from the regenerator 20, through the cooler 18, and into the compression space 26, working fluid temperature and pressure decrease and the piston 22 returns. Thus, the oscillating motion of the displacer 24 creates an oscillating pressure wave in the working fluid that moves the piston 22 in and out. The piston, acting on crank assembly 25, moves the displacer 24 to provide the pressure wave and also produces mechanical energy at an output shaft 28.

Before explaining the heater 16 of the invention, it is helpful to more fully understand particular elements of the pressure vessel 12 containing the working fluid. Referring to FIGS. 2 through 5, the pressure vessel 12 includes the cylinder 29, a tubular wall 30 about the cylinder, preferably axial internal fins 32 between the cylinder 29 and the wall 30, axial flow fluid passages 34 bounded by the cylinder 29, wall 30, and internal fins 32 between the cylinder and the wall, a transition cone 36, and an end cap 38. At the location of the transition cone 36 and above the end of the cylinder, radial ports 40 at the ends of the fluid passages 34 permit the working fluid to move alternately to and from the expansion space 27 and the axial flow fluid passages 34. In the preferred configuration, the cylinder ends below the ends of the passageways 40, as shown by the cross-hatching in FIG. 4. Alternatively, the cylinder 29 may extend higher and have ports cut into it that correspond to the ends of passages 34. The pressure vessel also includes a flange 39 which mates with the cooler 18 and provides a sealed annular opening at the bottom of the regenerator 20 for passage of the working fluid between the regenerator and the cooler.

The function of the heater 16 is to add heat to the pressurized working fluid within the axial fluid passages 34. The heater 16 is an annular heat exchanger which, according to a first preferred aspect of the invention, has external helical fins 42 integral with the exterior of wall 30 and axial internal fins 32 integral with the interior of wall 30. The helical fins 42 preferably taper away from wall 30, but may also have uniform thickness. An exemplar size for the fins includes a width of 0.125" at the root 42*a* of the fin (against the wall 30), a width of 0.06" at the tip 42*b*, and a height 42*c* of 0.5" (FIG. 5), though fins of other sizes may be used. It will be appreciated that because in FIG. 5 the fins are sectioned at an oblique angle, the exemplar preferred relative dimensions of the fins are distorted. An exemplar preferred lay angle for the helical fins 42 is one revolution every 3.5 inches about a 3.5 inch diameter wall 30. The helical fins 42 increase heat transfer across the wall 30 by effectively increasing the surface area of the wall that can be wetted (contacted) by the heating fluid. It will be appreciated that helical fins 42 are longer than either of annular fins or longitudinal fins, and therefore provide a relatively larger surface over which heat transfer between the heating fluid and the working fluid can occur. Longer fins 42 imply longer passages 48 and therefore more time for heat transfer with the heating fluid at any given heating fluid velocity. Furthermore, the helical fins 42 add substantial structural integrity to the heat exchanger.

According to a second preferred aspect of the invention, an outer tubular reinforcing sleeve 44 is attached to the outer edges of the helical fins 42. The resulting unified construction of the wall 30, axial fins 32, helical fins 42, and sleeve 44 provides a composite pressure vessel wall with an effective thickness much greater than the wall 30 alone; in effect, providing a wall with an effective wall strength approximating the combined material of the sleeve 44, the helical fins 42, axial fins 32, and the wall 30, while retaining the superior heat transfer performance of a single wall of the thickness of wall 30. As such, the sleeve 44 greatly improves the pressure resisting ability of the wall 30 resulting in a high-pressure and temperature heat exchanger with high heat transfer efficiency.

The sleeve 44, transition cone 36, lower portion of end cap 38, and wall 30 define a plenum 46 (FIG. 2) which distributes heating fluid to numerous inlets of the relatively long helical fluid passages 48 defined between the sleeve 44, the helical fins 42, and the wall 30. The number of helical fins 42 and passages 48 are optimized according to a particular application, and is based on factors such as fluid nature (liquid, gas, or a combination), fluid velocity, temperature, viscosity, etc. The thermal and structural properties of the wall 30, helical fins 42, axial fins 32, and sleeve 44 determine the optimum dimension of those components. A preferred material for both of the helical fins and sleeve is a high temperature, high strength metal or alloy, such as stainless steel or a superalloy including Inconel® NiCrFe alloy, Allvac Waspaloy® (UNS-N07001), Rene® 41, etc.

The sleeve 44 is preferably permanently bonded to the ends of the helical fins 42 by welding, casting, brazing, or some other permanent attachment process. The wall 30, axial fins 32, and helical fins 42 are also preferably a unitary construction. The cylinder 29 is optionally permanently bonded to the end of the axial fins 32 by welding or brazing to increase the pressure resisting strength of the vessel.

The heater 16 also includes an insulating barrier 54, an exhaust cylinder 56, and an insulating wall 58. The insulating barrier 54 deflects the heating fluid leaving the helical passages 48 at the bottom of the heater and protects the flange 39 and other engine components from heat. The exhaust cylinder 56 forms an exhaust passage 60 through which the heating fluid exhausts after passing through the helical passages 48. The exhaust cylinder can be insulated or non-insulated. Once heating fluid is exhausted, it can be directed to another location for use in preheating incoming fluid at 64 (FIG. 1) or other purposes needing heated fluid. The insulating wall 58 surrounds the sleeve 44 and insulates the sleeve from the relatively cooler heating fluid in the exhaust passage 60, thus maintaining a relatively high temperature at the sleeve.

The heater 16 is less expensive to produce than the tubular heat exchangers of the prior art, has increased surface area over traditional annular heat exchangers of the prior art, and does not have the thermal expansion and uneven heating problems associated with tubular heat exchangers.

In operation, heated fluid is created (e.g., as combustion gas) at 66 (FIG. 1). The heated fluid enters the system, surrounds the cap 38 (thereby heating the cap), and enters the plenum 46 of the heater 16. Because the net heat flow in the structure composed of the sleeve 44, helical fins 42, axial fins 32, and the wall 30 is from the fins 32 into the working fluid in passage 34, there is a temperature gradient created where the temperature of the sleeve 44 is higher than the temperature of the wall 30. As a result, there is heat transfer from the sleeve 44 and fins 42 to the wall 30 to heat the working fluid in the axial passages 34 defined by the axial fins 32.

The work output per revolution and efficiency of a Stirling engine are directly related to the high working fluid pressure and the temperature differential obtained. In view thereof, it will be appreciated that the ability of the heat exchanger 16 to operate under extremely high working fluid pressures (e.g., 150 psi-450 psi or more) and large temperature differentials (e.g., 1000° F. or more) permit the realization of a high efficiency heat exchanger and enable a relatively high power output and particularly efficient engine. The heat exchanger of the invention can be used anywhere a high efficiency high temperature heat exchanger operating with high-pressure fluid is needed.

There have been described and illustrated herein a Stirling engine and particularly a heat exchanger suitable for a Stirling engine. While particular embodiments of the invention have been described, it is not intended that the invention be limited thereto, as it is intended that the invention be as broad in scope as the art will allow and that the specification be read likewise. Thus, while a both helical fins and an outer reinforcing sleeve have been disclosed on the heat exchanger, it is believed that each component provides advantage over prior art heat exchanger, and each component may be used alone without the other. As such, the external fins may be radial or axial in shape with a reinforcing sleeve thereabout. Regardless of which shape, it is preferable that the angle between the internal and external fins should be relatively large (e.g., 70°–110°) such that the strengthening advantage of orthogonal grillage is maintained. In addition, if desired, bumps, wall variations and/or inserts can be added to the helical passages or axial passages to induce turbulence in the fluid flows and/or increase the surface area available for heat transfer. Also, while a particular heating fluid (combustion gas) has been disclosed, it will be appreciated that other heating fluids, in gas and liquid form, may be used as well. Furthermore, while the axial internal fins are described as defining axial flow passages, it will be appreciated that such fins may be radial or helical in shape, as this may be an advantage in lengthening the working fluid flow path to give more time for heat exchange at higher fluid velocities. In addition, the heating fluid direction may be reversed with flow through the helical fluid passages in the opposite direction. Flow may also be reversing or oscillating, if desired. Moreover, it will appreciated that the heat exchanger can be configured as a Stirling engine cooler. When used as a cooler, the sleeve and helical fins are preferably made from aluminum. Also, while particular materials have been disclosed, it will be appreciated that other suitable materials may be used. It will therefore be appreciated by those skilled in the art that yet other modifications could be made to the provided invention without deviating from its spirit and scope as claimed.

What is claimed is:

1. A Stirling engine, comprising:

a) a pressure vessel containing a working fluid;

b) a first heat exchanger means for heating said working fluid;

c) a second heat exchanger means for cooling said working fluid;

d) a regenerator for storing heat energy released by the working fluid; and e) a means for converting a pressure wave in said working fluid into mechanical energy, wherein at least one of said first and second heat exchangers includes (i) a tubular wall having an exterior surface, (ii) a plurality of helical fins about said exterior surface of said wall, and (iii) a tubular sleeve about and in contact with said helical fins, wherein said wall, said helical fins and said sleeve together define a plurality of helical fluid passages.

2. A Stirling engine according to claim 1, further comprising:

f) a heating fluid, wherein said helical fluid passages have an entrance and an exhaust, and said heating fluid is movable through said helical fluid passages; and g) means for transferring heat from heating fluid exiting said exhaust to heating fluid prior to said entrance.

3. A Stirling engine according to claim 1, wherein:

said helical fins and said sleeve are permanently bonded together.

4. A Stirling engine according to claim 1, wherein:

said helical fins and said sleeve are constructed of one of stainless steel and a superalloy.

5. A Stirling engine according to claim 1, wherein:

said at least one of said first and second heat exchangers further includes, (iii) a plurality of internal fins, wherein said wall and said internal fins are a unitary construct.

6. A Stirling engine according to claim 5, wherein:

said helical fins and said internal fins are in an orthogonal grillage relationship.

7. A Stirling engine according to claim 6, wherein:

said internal fins are oriented axial relative to said wall.

8. A Stirling engine, comprising:

a) a pressure vessel containing a working fluid;

b) a first heat exchanger means for heating said working fluid;

c) a second heat exchanger means for cooling said working fluid;

d) a regenerator for storing heat energy released by the working fluid; and e) a means for converting a pressure wave in said working fluid into mechanical energy, wherein at least one of said first and second heat exchangers includes (i) a tubular wall having an exterior surface, (ii) a plurality of external fins about said exterior surface of said wall, and (iii) a tubular sleeve about and in contact with said fins.

9. A Stirling engine according to claim 8, further comprising:

f) a heating fluid, wherein said tubular wall, said external fins and said tubular sleeve define a plurality of fluid passages having an entrance and an exhaust, and said heating fluid movable through said fluid passages; and g) means for transferring heat from heating fluid exiting said exhaust to heating fluid prior to said entrance.

10. A Stirling engine according to claim 8, wherein:

said external fins are one of annular, axial, and helical relative to said wall.

11. A Stirling engine according to claim 8, wherein:

said wall, said external fins, and said sleeve together define a plurality of fluid passages.

12. A Stirling engine according to claim 8, wherein:

said tubular wall has an interior surface provided with a plurality of internal fins.

13. A Stirling engine according to claim 12, wherein:

said internal fins are oriented axially relative to said tubular wall.

14. A Stirling engine according to claim 8, wherein:

said wall and said external fins are a unitary construct.

15. A Stirling engine according to claim 8, wherein:

said external fins and said sleeve are constructed of one of stainless steel and a superalloy.

16. A Stirling engine, comprising:

a) a pressure vessel containing a working fluid;

b) a first heat exchanger means for heating said working fluid;

c) a second heat exchanger means for cooling said working fluid;

d) a regenerator for storing heat energy released by the working fluid; and e) a means for converting a pressure wave in said working fluid into mechanical energy, wherein at least one of said first and second heat exchangers includes (i) a tubular wall having an exterior surface and an interior surface, (ii) a plurality of external fins about said exterior surface of said wall, (iii) a plurality of internal fins about said interior surface of said wall, wherein said wall, said external fins and said internal fins are a unitary construct, and (iv) a tubular sleeve provided about and permanently bonded to said external fins, wherein the integral construct of said wall, said external fins, said external fins and said tubular sleeve provides a relatively increase pressure resistance strength to said tubular wall.

17. A Stirling engine according to claim 16, wherein:

said tubular sleeve, said external fins, and said tubular wall define a plurality of fluid passages having an entrance and an exhaust.

18. A Stirling engine according to claim 17, further comprising:

f) a heating fluid movable through said fluid passages; and g) means for transferring heat from heating fluid exiting said exhaust to heating fluid prior to said entrance.

19. A Stirling engine according to claim 16, wherein:

said external fins are helical about said tubular wall.

20. A Stirling engine according to claim 16, wherein:

said external fins and said internal fins are in an orthogonal grillage relationship.

21. A Stirling engine according to claim 16, wherein:

said external fins and said tubular sleeve are constructed of one of stainless steel and a superalloy.

22. A Stirling engine according to claim 1, wherein:

in said at least one of said first and second heat exchangers, said wall and said helical fins are a unitary construct.

23. A Stirling engine according to claim 22, wherein:

said unitary construct is formed by casting.

24. A Stirling engine according to claim 22, wherein:

said at least one of said first and second heat exchangers further includes, (iii) a plurality of internal fins, wherein said internal fins are a unitary construct with said wall and said helical fins.

25. A Stirling engine according to claim 14, wherein:

said tubular sleeve is permanently bonded to said external fins.

26. A Stirling engine according to claim 12, wherein:

said internal fins, said wall, and said external fins are a unitary construct.

27. A Stirling engine according to claim 26, wherein:

said tubular sleeve is permanently bonded to said external fins.

28. A Stirling engine according to claim 27, wherein:

said permanent bond is effected by one of welding, casting, or brazing.

* * * * *